US012637263B2

(12) United States Patent
Berge et al.

(10) Patent No.: US 12,637,263 B2
(45) Date of Patent: May 26, 2026

(54) CLOSURE MULTIPLE FLEXING HINGE

(71) Applicant: Silgan White Cap LLC, Downers Grove, IL (US)

(72) Inventors: Gary L. Berge, Crystal Lake, IL (US); Sungsuk Steve Kim, Batavia, IL (US); Dustin S. Vance, Lombard, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 18/598,296

(22) Filed: Mar. 7, 2024

(65) Prior Publication Data

US 2024/0300706 A1 Sep. 12, 2024

Related U.S. Application Data

(63) Continuation of application No. PCT/US2024/018691, filed on Mar. 6, 2024.

(60) Provisional application No. 63/489,027, filed on Mar. 8, 2023.

(51) Int. Cl.
*B65D 47/08* (2006.01)

(52) U.S. Cl.
CPC ..... *B65D 47/0823* (2013.01)

(58) Field of Classification Search
CPC ..... B65D 47/0823
USPC ..... 220/254.3, 259.1, 817, 837, 839; 215/243
See application file for complete search history.

(56) References Cited

U.S. PATENT DOCUMENTS

| | | | | |
|---|---|---|---|---|
| 2,601,040 | A | 6/1952 | Livingstone | |
| 3,009,610 | A | 11/1961 | Kubiliunas | |
| 3,160,327 | A * | 12/1964 | Porcelli | B65D 47/103 220/837 |
| 3,168,221 | A | 2/1965 | Parker | |
| 4,454,958 | A * | 6/1984 | Juillet | B65D 51/247 220/837 |
| 4,550,862 | A | 11/1985 | Barker et al. | |
| 4,638,916 | A | 1/1987 | Beck et al. | |
| 4,795,044 | A | 1/1989 | Beck | |
| 4,801,054 | A | 1/1989 | Nycz | |
| 4,813,560 | A * | 3/1989 | Begley | B65D 47/0814 220/838 |

(Continued)

FOREIGN PATENT DOCUMENTS

| | | |
|---|---|---|
| DE | 3321000 A1 * | 12/1984 |
| GB | 2473042 | 3/2011 |

(Continued)

OTHER PUBLICATIONS

International Search Report and Written Opinion for International Application No. PCT/US2021/029674, dated Jul. 29, 2021, 10 pages.

(Continued)

*Primary Examiner* — Orlando E Aviles
*Assistant Examiner* — Niki M Eloshway
(74) *Attorney, Agent, or Firm* — Reinhart Boerner Van Deuren s.c.

(57) ABSTRACT

A closure includes a body and a cap flexible coupled to the body via a hinge. The cap actuates between an open position and a closed position with respect to the body via deflecting at the hinge, which includes more than one location that deflects as the cap is being opened and closed.

19 Claims, 6 Drawing Sheets

(56) References Cited

U.S. PATENT DOCUMENTS

| | | | | |
|---|---|---|---|---|
| 5,016,777 | A * | 5/1991 | Marvin | B65D 43/162 220/839 |
| 5,413,239 | A * | 5/1995 | Rider, Jr. | B65D 43/162 16/225 |
| 5,435,456 | A * | 7/1995 | Dubach | B65D 47/0814 220/838 |
| 5,642,824 | A | 7/1997 | Hess, III et al. | |
| 5,785,193 | A | 7/1998 | Kobayashi et al. | |
| 5,850,953 | A | 12/1998 | Dallas, Jr. | |
| 6,039,224 | A | 3/2000 | Dallas, Jr. et al. | |
| 6,398,076 | B1 | 6/2002 | Giblin et al. | |
| 6,851,586 | B2 | 2/2005 | Odet | |
| 6,932,249 | B1 | 8/2005 | Pugne | |
| 7,048,158 | B2 | 5/2006 | Hierzer | |
| D530,202 | S | 10/2006 | Herald et al. | |
| D576,875 | S | 9/2008 | Steiger et al. | |
| D610,454 | S | 2/2010 | Lohrman et al. | |
| D612,729 | S | 3/2010 | Lohrman et al. | |
| 7,721,901 | B1 | 5/2010 | Von Spreckelsen et al. | |
| D626,410 | S | 11/2010 | Lohrman et al. | |
| D626,412 | S | 11/2010 | Lohrman et al. | |
| D626,413 | S | 11/2010 | Lohrman et al. | |
| D636,671 | S | 4/2011 | Lohrman et al. | |
| D636,672 | S | 4/2011 | Lohrman et al. | |
| D636,673 | S | 4/2011 | Lohrman et al. | |
| 7,931,163 | B2 | 4/2011 | Von Spreckelsen et al. | |
| 8,308,022 | B2 * | 11/2012 | Barre | B65D 47/0828 220/837 |
| 8,469,213 | B2 * | 6/2013 | Ishii | B65D 41/3428 220/837 |
| 9,108,774 | B2 | 8/2015 | Kwon | |
| 9,187,219 | B2 | 11/2015 | Brannon et al. | |
| 9,272,824 | B2 | 3/2016 | Vogel et al. | |
| 9,415,909 | B2 | 8/2016 | Druitt et al. | |
| 9,580,216 | B2 | 2/2017 | Wisniewski | |
| 10,654,624 | B2 | 5/2020 | Sung | |
| 10,829,274 | B2 | 11/2020 | Pristera et al. | |
| 10,926,923 | B2 | 2/2021 | Berroa Garcia | |
| 2008/0000923 | A1 | 1/2008 | Berge | |
| 2008/0169261 | A1 | 7/2008 | Druitt et al. | |
| 2010/0219186 | A1 | 9/2010 | Kuwagaki et al. | |
| 2011/0000137 | A1 | 1/2011 | Druitt et al. | |
| 2011/0174760 | A1 | 7/2011 | Luzzato et al. | |
| 2012/0298666 | A1 | 11/2012 | Kwon | |
| 2015/0090743 | A1 * | 4/2015 | Wisniewski | B67D 3/0051 220/837 |
| 2022/0073238 | A1 | 3/2022 | Naumann et al. | |

FOREIGN PATENT DOCUMENTS

| | | |
|---|---|---|
| JP | 2003-221053 | 8/2003 |
| JP | 2017-007698 | 1/2017 |
| JP | 2019-055816 | 4/2019 |
| WO | WO2019/175740 | 9/2019 |

OTHER PUBLICATIONS

International Search Report and Written Opinion issued in International Application No. PCT/US2024/018691, dated Jul. 1, 2024, 12 pages.

* cited by examiner

CLOSURE MULTIPLE FLEXING HINGE

CROSS-REFERENCE TO RELATED PATENT APPLICATIONS

The present application is a continuation of International Application No. PCT/US2024/018691, filed Mar. 6, 2024, which claims the benefit of and priority to U.S. Provisional Application No. 63/489,027, filed on Mar. 8, 2023, each of which is incorporated herein by reference in its entirety.

BACKGROUND OF THE INVENTION

The present disclosure relates generally to the field of closures for containers. The present disclosure relates specifically to a closure for a container including a body and cap coupled to the body via a hinge. The hinge includes more than one portion that deflects when the cap is opened and closed with respect to the body.

SUMMARY OF THE INVENTION

One embodiment of the invention relates to a closure including an axis, a closure body configured to couple to a container neck, the closure body centered on the axis, a cap, and a hinge. The closure body includes a top wall, an annular wall extending downward from the top wall, and a thread extending from the annular wall inward towards the axis. The thread is configured to engage the container neck thereby coupling the closure body to the container neck. The cap is coupled to the closure body, such as pivotally coupled. The cap is configured to actuate between a closed position and an open position with respect to the closure body, and the cap actuates 180 degrees when actuating between the open position to the closed position. The hinge extends between the cap and the closure body, the hinge including a first portion, a second portion distinct from the first portion, and a rib between the first portion and the second portion. Each of the first portion and the second portion deflect as the cap actuates between the closed position and the open position with respect to the closure body, and the rib is thicker than each of the first portion and the second portion.

In a specific embodiment, the closure includes a first band extending between the cap and the closure body, and a second band extending between the cap and the closure body. The first band and the second band are circumferentially positioned on opposing sides of the hinge.

In a specific embodiment, the first portion is closer to the closure body than the second portion when the cap is in the open position, the first portion deflects a first angle and the second portion deflects a second angle when the cap actuates between the open position and the closed position with respect to the closure body, and the first angle is greater than the second angle.

In a specific embodiment, the first angle is at least 60 degrees. In a specific embodiment, the second angle is no more than 80 degrees.

Another embodiment of the invention relates to a closure including an axis, a closure body configured to couple to a container neck, the closure body centered on the axis, a cap coupled to the closure body, and a hinge extending between the cap and the closure body. The closure body includes a top wall, an annular wall extending downward from the top wall, and a thread extending from the annular wall inward towards the axis, the thread configured to engage the container neck thereby coupling the closure body to the container neck. The cap is configured to actuate between a closed position and an open position with respect to the closure body. The hinge includes a first portion and a second portion distinct from the first portion. Each of the first portion and the second portion deflect as the cap actuates between the closed position and the open position with respect to the closure body. The first portion defines a first thickness and the second portion defines a second thickness, and the second thickness is greater than the first thickness.

In a specific embodiment, the second thickness is at least 15% thicker than the first thickness. In a specific embodiment, the second thickness is at least 35% thicker than the first thickness. In a specific embodiment, the second thickness is no more than 60% thicker than the first thickness. In a specific embodiment, the second thickness is no more than 45% thicker than the first thickness. In a specific embodiment, the hinge includes a rib between the first portion and the second portion, the first portion is closer to the closure body than each of the rib and the second portion when the cap is in the open position, and the rib is thicker than each of the first portion and the second portion.

In a specific embodiment, the first portion deflects a first angle and the second portion deflects a second angle when the cap actuates between the open position and the closed position with respect to the closure body, the first angle is at least 60 degrees, and the second angle is no more than 80 degrees.

In a specific embodiment, the first portion is closer to the closure body than the second portion when the cap is in the open position.

In a specific embodiment, the second thickness is between 30% and 50% thicker than the first thickness.

Another embodiment of the invention relates to a closure including an axis, a closure body configured to couple to a container neck, the closure body centered on the axis, a cap coupled to the closure body, and a hinge extending between the cap and the closure body. The closure body includes a top wall, an annular wall extending downward from the top wall, and a thread extending from the annular wall inward towards the axis, the thread configured to engage the container neck thereby coupling the closure body to the container neck. The cap is configured to actuate between a closed position and an open position with respect to the closure body. The hinge includes a first portion and a second portion distinct from the first portion, and each of the first portion and the second portion deflect as cap actuates between the closed position and the open position with respect to the closure body. The first portion is closer to the closure body than the second portion when the cap is in the open position. The first portion deflects a first angle between 60 and 160 degrees and the second portion deflects a second angle between 20 and 80 degrees when the cap actuates between the open position and the closed position with respect to the closure body.

In a specific embodiment, the first angle is no more than 140 degrees. In a specific embodiment, the second angle is at least 40 degrees.

In a specific embodiment, the hinge includes a rib between the first portion and the second portion, and the rib is thicker than each of the first portion and the second portion.

In a specific embodiment, the first portion is closer to the closure body than the second portion when the cap is in the open position, and wherein the first angle is greater than the second angle.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments. In addition, alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
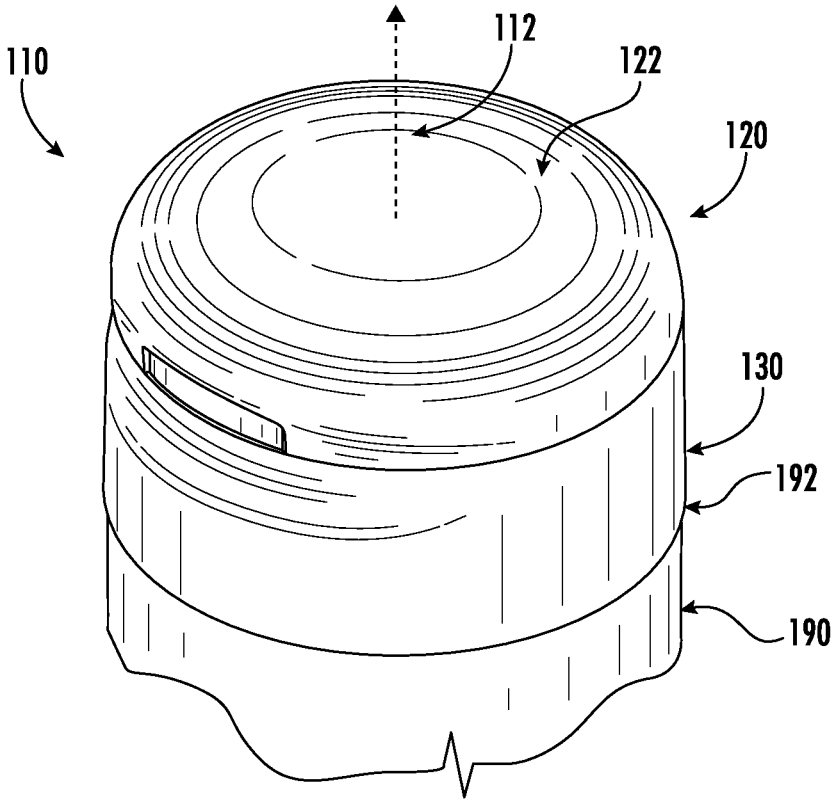
FIG. 1 is a perspective view of a closure from the front, according to an exemplary embodiment.

This disclosure provides a description for a closure with a closure body and a cap flexibly coupled to the body via a hinge. The hinge deflects in two different locations as the cap opens and closes with respect to the body. In various embodiments the hinge includes a protrusion, such as a rib, that interfaces with the body of the hinge to change the hinge location that is deflecting as the closure actuates from the open position to the closed position. Applicant has observed that providing multiple flexing locations in the hinge reduces the stress on the hinge because each flexing location does not need to flex over as wide an angle compared to closure hinges with only a single flexing location, thereby improving strength and longevity of the hinge and closure.

Referring to FIGS. 1-5, various aspects of a closure 110 for containers are provided, such as containers configured to store and dispense liquids for consumption. Closure 110 includes closure body 130 and cap 120 coupled to closure body 130 via one or more of hinge 160, first band 150 and second band 152. In various embodiments, cap 120 is pivotally coupled to closure body 130. In various embodiments, closure body 130 and cap 120 are centered on axis 112. Closure body 130 is configured to couple to a container neck, such as container neck 192 of container 190.

First band 150 and second band 152 extend between cap 120 and closure body 130 such that each of first band 150 and second band 152 are coupled at one end to closure body 130 and at an opposing end to cap 120. First band 150 and second band 152 are circumferentially positioned on opposing sides of hinge 160.

Figure 3:
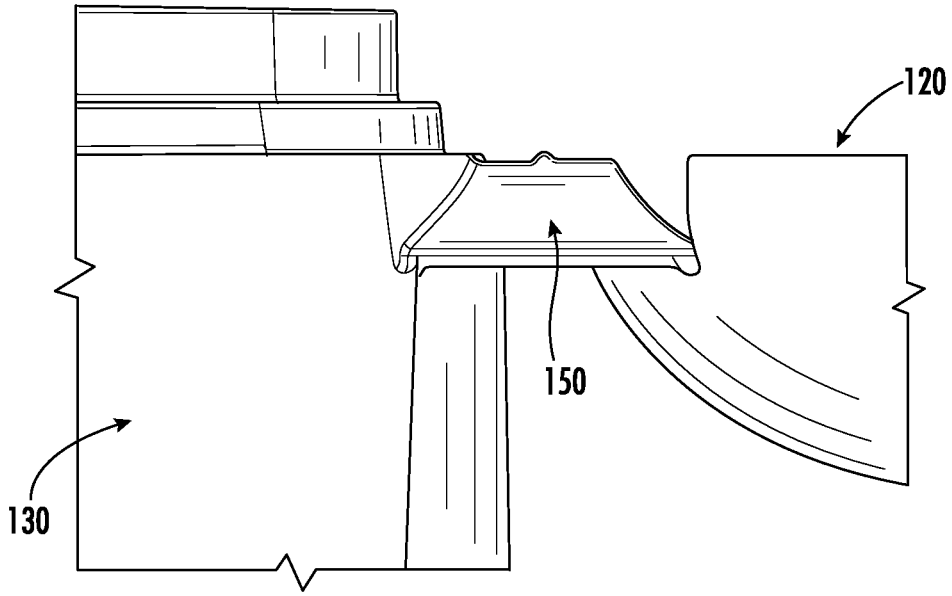
FIG. 3 is a detailed side view of the closure of FIG. 1, according to an exemplary embodiment.

In use, cap 120 is configured to actuate with respect to closure body 130 between a closed position (FIG. 1) and an open position (FIG. 3). In various embodiments, cap 120 actuates 180 degrees when actuating between the open position and the closed position.

Hinge 160 extends between cap 120 and closure body 130. As will be explained, hinge 160 includes multiple flexing locations that flex as the cap 120 actuates between the open position and the closed position, such as first portion 164 and second portion 174. In various embodiments, the second portion 174 is distinct from the first portion 164, such as via being separated by rib 170. In various embodiments, first portion 164 is closer to closure body 130 than second portion 174 when cap 120 is in the open position.

In various embodiments, rib 170 is between first portion 164 and second portion 174. In various embodiments, rib 170 is thicker than each of first portion 164 and second portion 174.

Applicant has observed that providing multiple flexing locations in hinge 160 reduces the stress on hinge 160 because each flexing location does not need to flex over as wide an angle compared to closure hinges with only a single flexing location. In various embodiments, each of first portion 164 and second portion 174 deflect as cap 120 actuates between the closed position and the open position with respect to the closure body 130.

Figure 4:
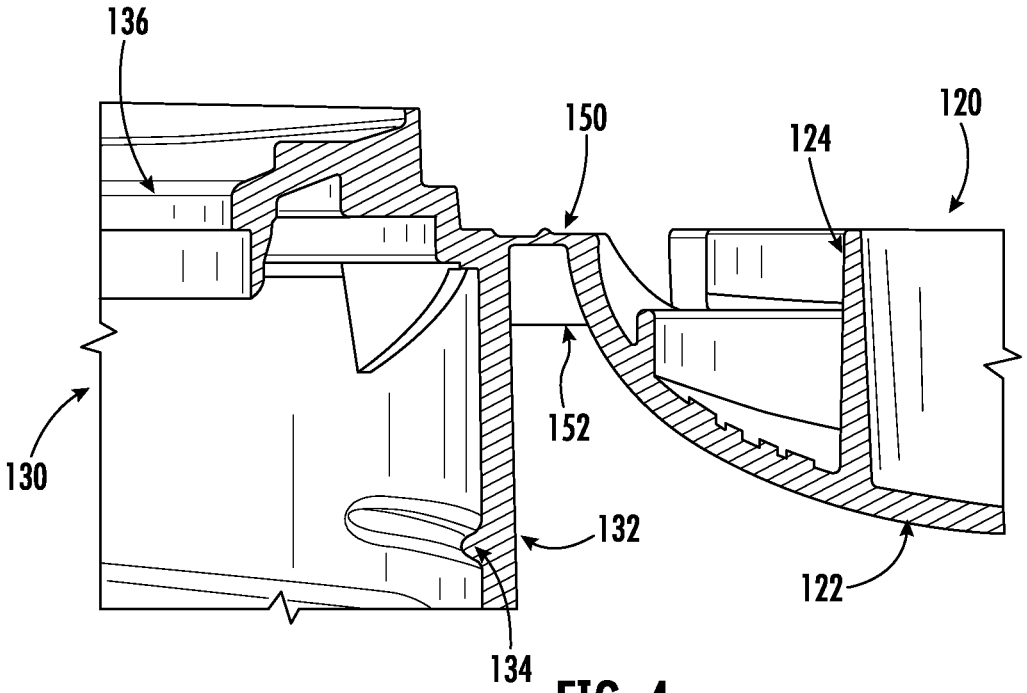
FIG. 4 is a cross-section view of the closure of FIG. 1, according to an exemplary embodiment.

Referring to FIG. 4, closure body 130 includes a top wall 122 and annular wall 132 extending downward from the top wall 122. In various embodiments, annular wall 132 is centered around axis 112. A coupling arrangement, shown as thread 134, extends from annular wall 132. Thread 134 is configured to engage the container neck 192 thereby coupling closure body 130 to the container neck 192 and container 190 the closure 110 is affixed to. When cap 120 is in the open position, opening 136 provides fluid communication between the storage area of the container and outside the container.

Cap 120 includes top wall 122 and internal wall 124 extending downward from top wall 122. In use, when cap 120 is in the closed position with respect to closure body 130, internal wall 124 interfaces with closure body 130 to secure the contents within the container, such as by cap 120 preventing and/or reducing fluid communication between the storage area of the container and outside the container.

Figure 5:
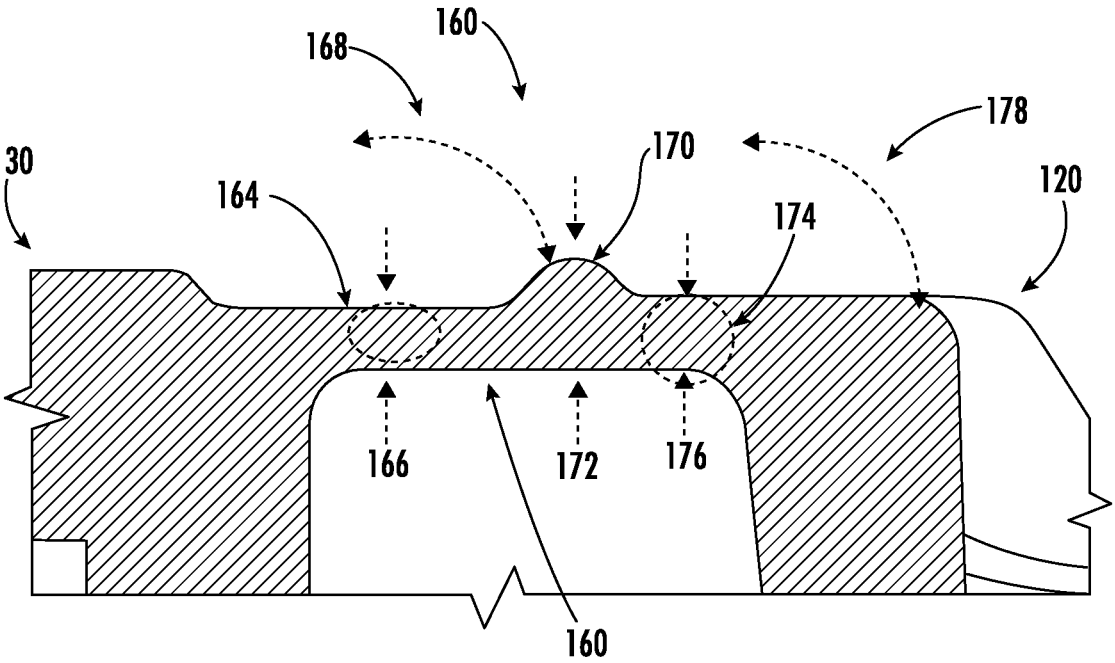
FIG. 5 is a detailed cross-section view of the closure of FIG. 4, according to an exemplary embodiment.

Referring to FIG. 5, various aspects of hinge 160 are shown. In various embodiments, hinge 160 includes body 162 extending between cap 120 and closure body 130 such that cap 120 is coupled to a first end of hinge 160 and closure body 130 is coupled to an opposing second end of hinge 160.

In various embodiments, hinge 160 includes a first portion 164, a rib 170, and a second portion 174. Rib 170 is between the first portion 164 and the second portion 174 and rib 170 extends above each of first portion 164 and the second portion 174 when cap 120 is in the open position. First portion 164 defines first thickness 166, second portion 174 defines second thickness 176, and rib 170 defines thickness 172. In various embodiments, first thickness 166, thickness 172, and second thickness 176 are measured along an axis parallel to axis 112 when cap 120 is in the open position with respect to closure body 130 (see FIG. 5). In various embodiments, thickness 172 of rib 170 is thicker than each of first thickness 166 of first portion 164 and second thickness 176 of second portion 174. Applicant has observed that the thicknesses described herein improve the flexing characteristics of hinge 160, such as by reducing the amount of stress imposed on individual portions of hinge 160, thereby increasing the strength and longevity of hinge 160 and by extension closure 110.

In various embodiments, second thickness 176 of second portion 174 is thicker than first thickness 166 of first portion 164. In various embodiments, second thickness 176 of second portion 174 is between 15% and 60% thicker than first thickness 166 of first portion 164, and more specifically between 30% and 50%, and more specifically between 35% and 45%, and more specifically 40%. In various embodiments, second thickness 176 of second portion 174 is between 15% and 60% thicker than first thickness 166 of first portion 164, and more specifically between 15% and 30%, and more specifically 18%.

In various embodiments, second thickness 176 of second portion 174 is between 10% and 50% thicker than first thickness 166 of first portion 164, and more specifically between 20% and 45%, and more specifically between 25% and 40%, and more specifically between 30% and 35%, and more specifically 33%.

In various embodiments, second thickness 176 of second portion 174 is at least 15% thicker than first thickness 166 of first portion 164, and more specifically at least 30% thicker, and more specifically at least 35% thicker. In various embodiments, second thickness 176 of second portion 174 is no more than 60% thicker than first thickness 166 of first portion 164, and more specifically no more than 50% thicker, and more specifically no more than 45% thicker, and more specifically no more than 30% thicker. In various embodiments, second thickness 176 of second portion 174 is at least 10% thicker than first thickness 166 of first portion 164, and more specifically at least 20% thicker, and more specifically at least 25% thicker, and more specifically at least 30% thicker. In various embodiments, second thickness 176 of second portion 174 is no more than 50% thicker than first thickness 166 of first portion 164, and more specifically no more than 45% thicker, and more specifically no more than 40% thicker, and more specifically no more than 35% thicker.

Figure 2:
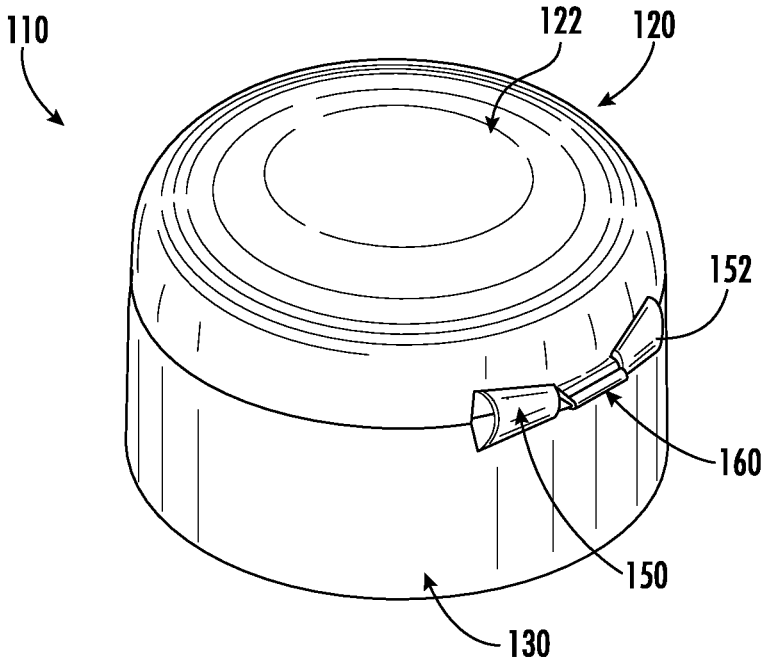
FIG. 2 is a perspective view of the closure of FIG. 1 from the rear, according to an exemplary embodiment.
Figure 6:
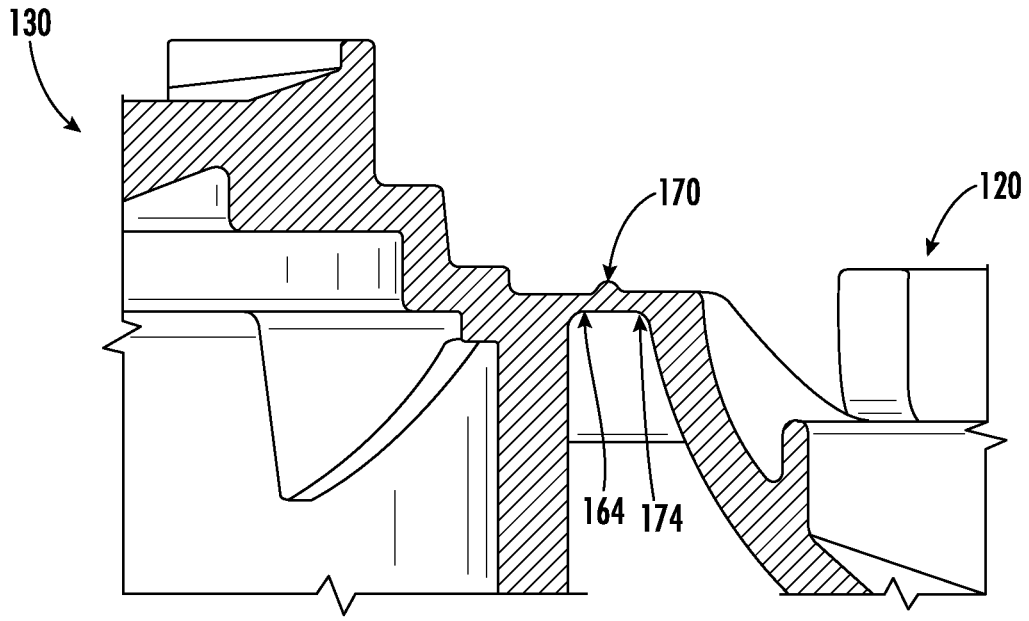
FIGS. 6-10 is a series of detailed cross-section views of the closure of FIG. 4 as the closure is being opened, according to an exemplary embodiment.
Figure 7:
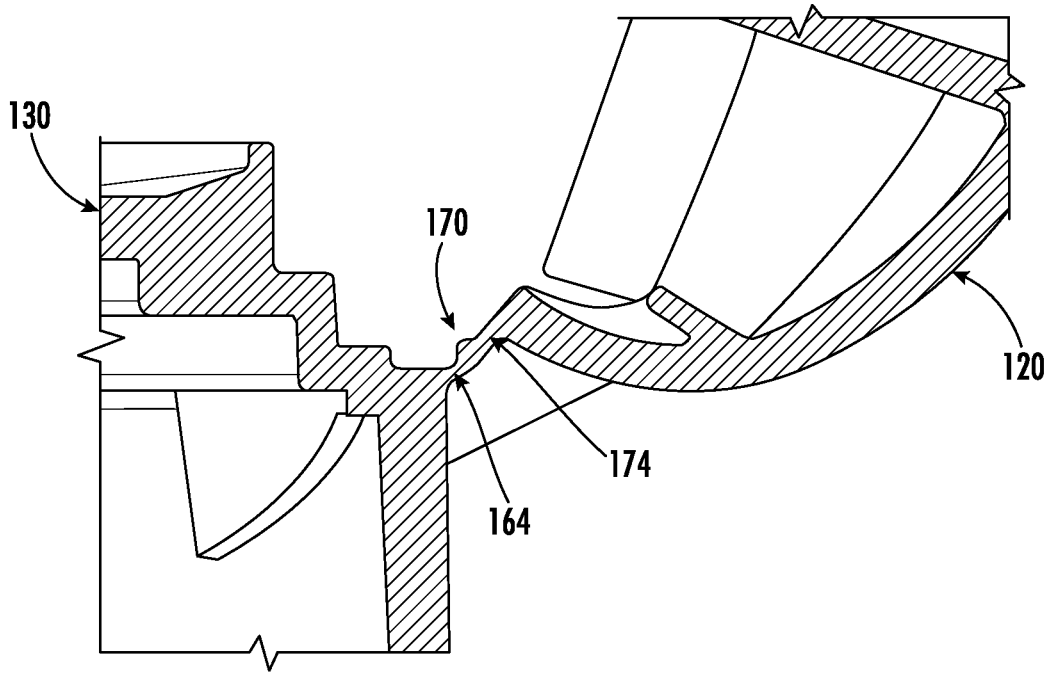

In various embodiments, when cap 120 actuates from the open position to the closed position with respect to closure body 130, hinge 160 deflects at two or more locations. In various embodiments, cap 120 actuating from the open position (FIG. 6) to the closed position (FIGS. 1-2) includes cap 120 rotating 180 degrees with respect to closure body 130. Stated another way, in various embodiments cap 120 actuating from the open position (FIGS. 3-6) to the closed position (FIGS. 1-2) includes cap 120 rotating 180 degrees with respect to closure body 130 such that upper surface of top wall 122 rotates from facing vertically downward in the open position (FIGS. 3-6) to vertically upward in the closed position (FIGS. 1-2).

In a specific embodiment, hinge 160 deflects at each of first portion 164 and second portion 174, with first portion 164 deflecting (e.g., bending) first angle 168 and second portion 174 deflecting (e.g., bending) second angle 178 when the cap actuates between the open position and the closed position with respect to the closure body. In various embodiments, first angle 168 is greater than second angle 178. Applicant has observed that the angles of deflection for first portion 164 and second portion 174 described herein improve the flexing characteristics of hinge 160, such as by reducing the amount of stress imposed on individual portions of hinge 160, thereby increasing the strength and longevity of hinge 160 and by extension closure 110.

In various embodiments, first angle 168 is between 60 degrees and 160 degrees, and more specifically between 110 degrees and 150 degrees, and more specifically between 120 degrees and 140 degrees, and more specifically between 125 degrees and 135 degrees, and more 130 degrees. In various embodiments, first angle is at least 60 degrees, and more specifically at least 110 degrees, and more specifically at least 120 degrees, and more specifically at least 125 degrees. In various embodiments, first angle is no more than 160 degrees, and more specifically no more than 150 degrees, and more specifically no more than 140 degrees, and more specifically no more than 135 degrees.

In various embodiments, second angle 178 is between 20 degrees and 80 degrees, and more specifically between 30 degrees and 70 degrees, and more specifically between 40 degrees and 60 degrees, and more specifically between 45 degrees and 55 degrees, and more 50 degrees. In a specific embodiment, each of first angle 168 and second angle 178 is between 45 degrees and 135 degrees. In various embodiments, second angle is at least 20 degrees, and more specifically at least 30 degrees, and more specifically at least 40 degrees, and more specifically at least 45 degrees. In various embodiments, second angle is no more than 80 degrees, and more specifically no more than 70 degrees, and more specifically no more than 60 degrees, and more specifically no more than 55.

In various embodiments, first angle 168 is between 60 degrees and 160 degrees, and more specifically between 100 degrees and 140 degrees. In various embodiments, first angle 168 is 130 degrees. In various embodiments, first angle 168 is 112 degrees. In various embodiments, first angle 168 is 115 degrees. In various embodiments, first angle is at least 60 degrees, and more specifically at least 100 degrees. In various embodiments, first angle is no more than 160 degrees, and more specifically no more than 140 degrees.

In various embodiments, second angle 178 is between 10 degrees and 60 degrees. In various embodiments, second angle 178 is 15 degrees. In various embodiments, second angle 178 is 16 degrees. In various embodiments, second angle 178 is 20 degrees. In various embodiments, second angle 178 is 29 degrees. In various embodiments, second angle is at least 10 degrees. In various embodiments, second angle is no more than 60 degrees.

Figure 8:
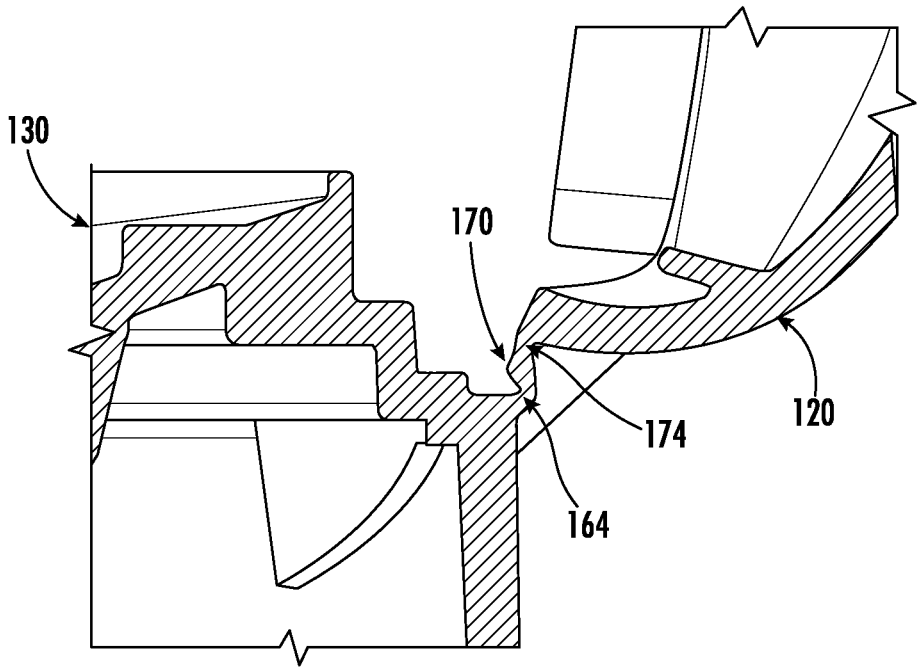
Figure 9:
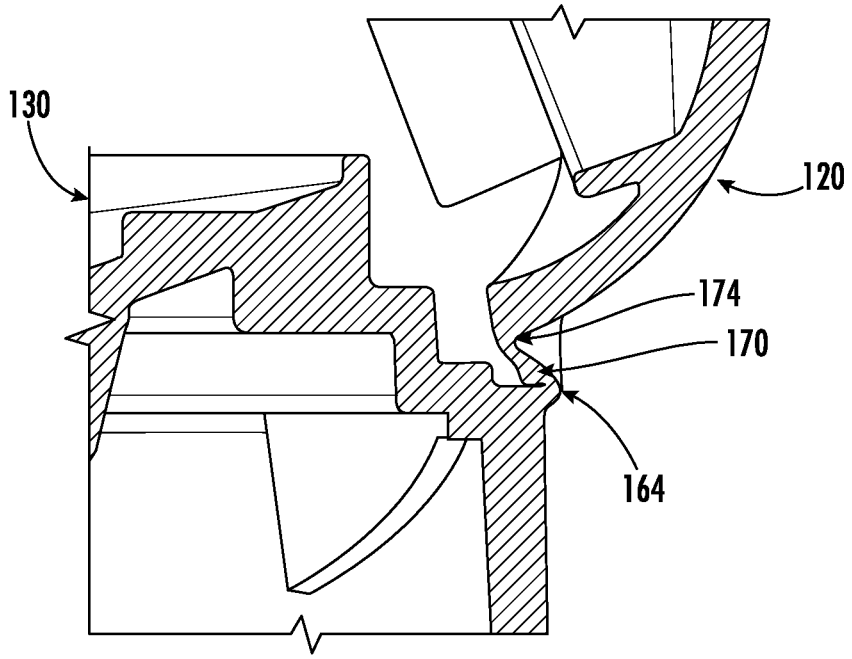
Figure 10:
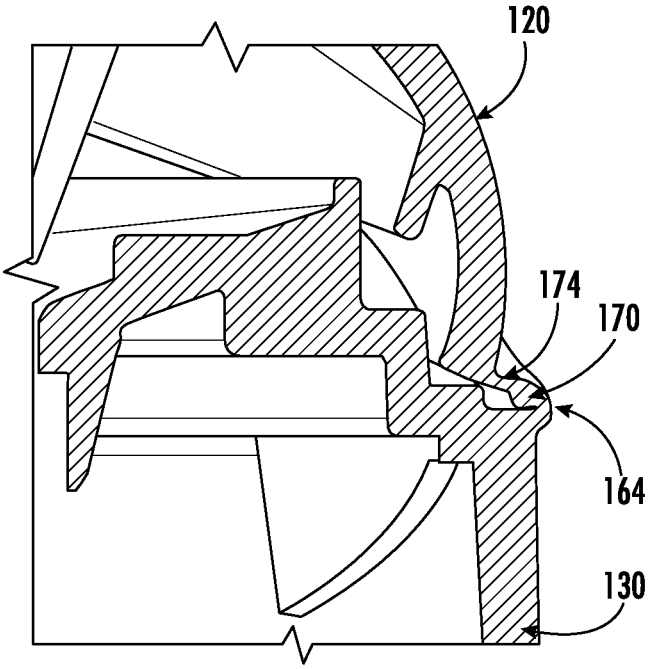

Referring to FIGS. 6-10, various aspects of closure 110 are shown as cap 120 actuates from the closed position to the open position with respect to closure body 130. First portion 164 initially deflects as cap 120 actuates from the closed position to the open position (FIG. 7) until first portion 164 deflects approximately 130 degrees (FIGS. 8-9). At that point, as cap 120 continues to actuate to the closed position then rib 170 interfaces against the upper surface of hinge 160 thereby biasing and/or preventing first portion 164 from deflecting further (FIG. 9). Subsequently, second portion 174 deflects as cap 120 continues to actuate from the closed position to the open position with respect to closure body 130 (FIG. 10).

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A closure comprising:

an axis;

a closure body configured to couple to a container neck, the closure body centered on the axis and comprising:

a top wall;

an annular wall extending downward from the top wall; and a thread extending from the annular wall inward towards the axis, the thread configured to engage the container neck thereby coupling the closure body to the container neck;

a cap coupled to the closure body, the cap configured to actuate between a closed position and an open position with respect to the closure body, wherein the cap actuates 180 degrees when actuating between the open position to the closed position; and a hinge extending between the cap and the closure body, the hinge comprising a first portion, a second portion distinct from the first portion, and a rib between the first portion and the second portion, wherein each of the first portion and the second portion deflect as the cap actuates between the closed position and the open position with respect to the closure body, wherein the rib is thicker than each of the first portion and the second portion, wherein the first portion defines a first uniform thickness between the closure body and the rib, and wherein the second portion defines a second uniform thickness between the cap and the rib, and wherein the hinge extends a length from the closure body to the cap, and the rib extends less than half the length.

2. The closure of claim 1, comprising:

a first band extending between the cap and the closure body; and a second band extending between the cap and the closure body, wherein the first band and the second band are circumferentially positioned on opposing sides of the hinge.

3. The closure of claim 1, wherein the first portion deflects a first angle and the second portion deflects a second angle when the cap actuates between the open position and the closed position with respect to the closure body, and wherein the first angle is greater than the second angle.

4. The closure of claim 3, wherein the first angle is at least 60 degrees.

5. The closure of claim 4, wherein the second angle is no more than 80 degrees.

6. The closure of claim 3, wherein the second angle is no more than 80 degrees.

7. A closure comprising:

an axis;

a closure body configured to couple to a container neck, the closure body centered on the axis and comprising:

a top wall;

an annular wall extending downward from the top wall; and a thread extending from the annular wall inward towards the axis, the thread configured to engage the container neck thereby coupling the closure body to the container neck;

a cap coupled to the closure body, the cap configured to actuate between a closed position and an open position with respect to the closure body; and a hinge extending between the cap and the closure body, the hinge comprising a first portion and a second portion distinct from the first portion and separated from each other by a rib, wherein each of the first portion and the second portion deflect as the cap actuates between the closed position and the open position with respect to the closure body, wherein the first portion defines a first uniform thickness between the closure body and the rib, and the second portion defines a second uniform thickness between the cap and the rib, wherein the second thickness is greater than the first thickness, wherein the hinge extends a length from the closure body to the cap, and the rib extends less than half the length.

8. The closure of claim 7, wherein the second thickness is at least 15% thicker than the first thickness.

9. The closure of claim 7, wherein the second thickness is at least 35% thicker than the first thickness.

10. The closure of claim 7, wherein the second thickness is no more than 60% thicker than the first thickness.

11. The closure of claim 7, wherein the second thickness is no more than 45% thicker than the first thickness.

12. The closure of claim 7, wherein the rib is thicker than each of the first portion and the second portion.

13. The closure of claim 7, wherein the first portion deflects a first angle and the second portion deflects a second angle when the cap actuates between the open position and the closed position with respect to the closure body, wherein the first angle is at least 60 degrees, and wherein the second angle is no more than 80 degrees.

14. The closure of claim 7, wherein the second thickness is between 30% and 50% thicker than the first thickness.

15. A closure comprising:

an axis;

a closure body configured to couple to a container neck, the closure body centered on the axis and comprising:

a top wall;

an annular wall extending downward from the top wall; and a thread extending from the annular wall inward towards the axis, the thread configured to engage the container neck thereby coupling the closure body to the container neck;

a cap coupled to the closure body, the cap configured to actuate between a closed position and an open position with respect to the closure body; and a hinge extending between the cap and the closure body, the hinge comprising a first portion and a second portion distinct from the first portion and separated from each other by a rib, wherein each of the first portion and the second portion deflect as the cap actuates between the closed position and the open position with respect to the closure body, wherein the first portion is closer to the closure body than the second portion when the cap is in the open position, and wherein the first portion deflects a first angle between 60 and 160 degrees and the second portion deflects a second angle between 20 and 80 degrees when the cap actuates between the open position and the closed position with respect to the closure body, wherein the first portion defines a first uniform thickness between the closure body and the rib, and wherein the second portion defines a second uniform thickness between the cap and the rib, and wherein the hinge extends a length from the closure body to the cap, and the rib extends less than half the length.

16. The closure of claim 15, wherein the first angle is no more than 140 degrees.

17. The closure of claim 16, wherein the second angle is at least 40 degrees.

18. The closure of claim 15, wherein the rib is thicker than each of the first portion and the second portion.

19. The closure of claim 15, wherein the first portion is closer to the closure body than the second portion when the cap is in the open position, and wherein the first angle is greater than the second angle.

* * * * *